US005232096A

United States Patent [19]

Weit

[11] Patent Number: 5,232,096

[45] Date of Patent: Aug. 3, 1993

[54] MATERIAL DISPERSION APPARATUS

[75] Inventor: Herbert Weit, Beckum, Fed. Rep. of Germany

[73] Assignee: Christian Pfeiffer Maschinenfabrik GmbH & Co. KG, Beckum, Fed. Rep. of Germany

[21] Appl. No.: 789,262

[22] Filed: Nov. 8, 1991

[30] Foreign Application Priority Data

Nov. 8, 1990 [DE] Fed. Rep. of Germany ... 9015363[U]

[51] Int. Cl.[5] ..... B07B 4/00

[52] U.S. Cl. ..... 209/135; 209/139.2; 209/148

[58] Field of Search ..... 209/134, 135, 139.2, 209/146, 148

[56] References Cited

U.S. PATENT DOCUMENTS

| | | | |
|---|---|---|---|
| 530,445 | 12/1894 | Newby | 209/139.2 |
| 1,962,455 | 6/1934 | Montgomery | 209/139.2 |
| 3,474,903 | 10/1969 | Ausherman | 209/135 X |
| 3,620,370 | 11/1971 | Swayze | 209/135 X |
| 3,960,714 | 6/1976 | Strauss | 209/148 X |
| 4,059,507 | 11/1977 | Nobuo | 209/148 X |
| 4,792,393 | 12/1988 | Blasczyk et al. | 209/135 |
| 4,799,595 | 1/1989 | Binder | 209/135 |
| 5,024,754 | 6/1991 | Patzelt et al. | 209/135 |

FOREIGN PATENT DOCUMENTS

| | | | |
|---|---|---|---|
| 0316305 | 5/1989 | European Pat. Off. | 209/134 |
| 1482455 | 5/1970 | Fed. Rep. of Germany | 209/134 |
| 3621221 | 1/1988 | Fed. Rep. of Germany . | |
| 1316717 | 6/1987 | U.S.S.R. | 209/135 |

*Primary Examiner*—Robert P. Olszewski
*Assistant Examiner*—James R. Bidwell
*Attorney, Agent, or Firm*—Keck, Mahin & Cate

[57] ABSTRACT

The invention relates to a material dispersion apparatus, particularly for spreading classifiers, with an upper material supply and a material feed surface. The material feed surface is constructed as a sieve-like surface, which is installed in an air channel and the material supply is fluidized above the sieve-like surface and discharged over the outer rim of the material feed surface to fall down to the spreading classifier basket.

19 Claims, 2 Drawing Sheets

MATERIAL DISPERSION APPARATUS

BACKGROUND OF THE INVENTION

The invention relates to an apparatus with a vertical rotation axis for dispersing material.

An apparatus of the aforementioned type is e.g. known from DE 36 21 221 C2. I n this known apparatus, which makes use of a multistage spreading or scattering classifier, inverted conical hydroextractors or whizzers are used in conventional manner. Although in multistage processes a relatively good, uniform distribution of the material to be classified takes place upstream of the classifying chamber, in a single-stage hydroextractor there is always a danger of a strand-like distribution of the material hurled away from the upper edge of the hydroextractory by centrifugal forces, so that subsequently an optimum classification cannot be carried out.

The material dispersion achieved with hydroextractors is consequently inadequate and there is generally a rigid coupling with the rotation of the corresponding classifier basket. A corresponding hydroextractor speed relative to the classifier basket can only be achieved by means of a relatively complicated construction of different drives.

SUMMARY AND OBJECTS OF THE INVENTION

Taking account of these disadvantages, the object of the invention is to provide a material dispersion apparatus, which has a relatively simple construction and which makes it possible to achieve a homogenization of the material dispersion, whilst bringing about relatively simple control possibilities, also independent of the rotation of the classifier basket.

According to the invention this object is achieved by an apparatus for a spreading classifier with a vertical rotation axis for the dispersion of material, with an upper material supply means and a material feed surface substantially coaxial to the vertical rotation axis of the spreading classifier and which has a marginal area via which the dispersed material is supplied to a classifying chamber and with a channel means for a gaseous fluid, the channel means having a sieve-like surface, which is constructed as a material feed surface.

The essence of the material dispersion is the arrangement of a sieve or perforation-like surface as a material feed surface and below which a gas or air flow is produced in the rising direction.

In the simplest manner this can be achieved by a type of air channel, which can e.g. have a rectangular U-contour, the sieve-like surface being provided at roughly half the height of the channel. Below the sieve-like surface there are one or more subdivided air chambers, so that by means of inflowing compressed air the material dropping on to the sieve-like surface is so-to-speak fluidized. The material fed into the air channel from above and which is preferably supplied by means of several, uniformly spaced material supply lines, is consequently fluidized by the inflowing air even in the case of a stationery air channel, is kept above the sieve-like surface and to it is optionally imparted a rotary movement, so that the infed material flows virtually as in a water trough. Simultaneously by means of an inclination of the air channel or additionally or alternatively by guidance plates in the actual air channel, the material to be classified uniformly dispersed over the radially outer edge can be introduced into the underlying, annular classifying chamber. The compressed air or some other gas can be supplied at the bottom of the air channel or on its side walls in order to improve the material outflow.

Appropriately the height of the sieve-like surface over the bottom of the air channel can be adjusted. The supplied compressed air can be regulated from both the pressure and volume standpoints with respect to the material feed volume and its structure.

In place of a rectangular contour the air channel can also have a roughly semicircular contour in vertical section.

Conventionally the air channel is arranged horizontally and a slight radially outward inclination is desirable for achieving a better outflow of the dispersed product.

A spiral arrangement of the air channel in the vertical direction is possible and, as a function f the intended uses, an advantageous dispersion can be obtained through several material feeds and air chambers.

In the case of several air chambers, the end face thereof can be guided upwards against the sieve-like surface in the manner of an oblique plane, so that the suspension forces acting from below against the material particles can be improved. The sieve and perforation formation can also in this connection help to determine an outflow direction of the compressed air.

For the further dispersion of the material rotating dispersing blades are appropriately provided somewhat below the air channel and as a result there can be a further rotary influencing of the predispersed material. The external diameter of said dispersing or accelerating blades roughly corresponds to the external diameter of the air channel and can be slightly larger.

A material dispersion apparatus constructed in this way also allows an optimum control influencing of the infed material with respect to a uniform, homogeneous distribution over the entire circumference and this can be achieved with a simple construction. The rotation and suspension of the material can also be influenced by means of the different compressed air conditions and there is a complete independence of the classifier basket drive.

The feed direction for the supplied material is appropriately in the flow direction of the material volume fluidized in the air channel.

BRIEF DESCRIPTION OF THE DRAWINGS

The invention is described in greater detail hereinafter relative to non-limitative embodiments and the attached drawings, wherein show.

DESCRIPTION OF THE PREFERRED EMBODIMENTS

Figure 1:
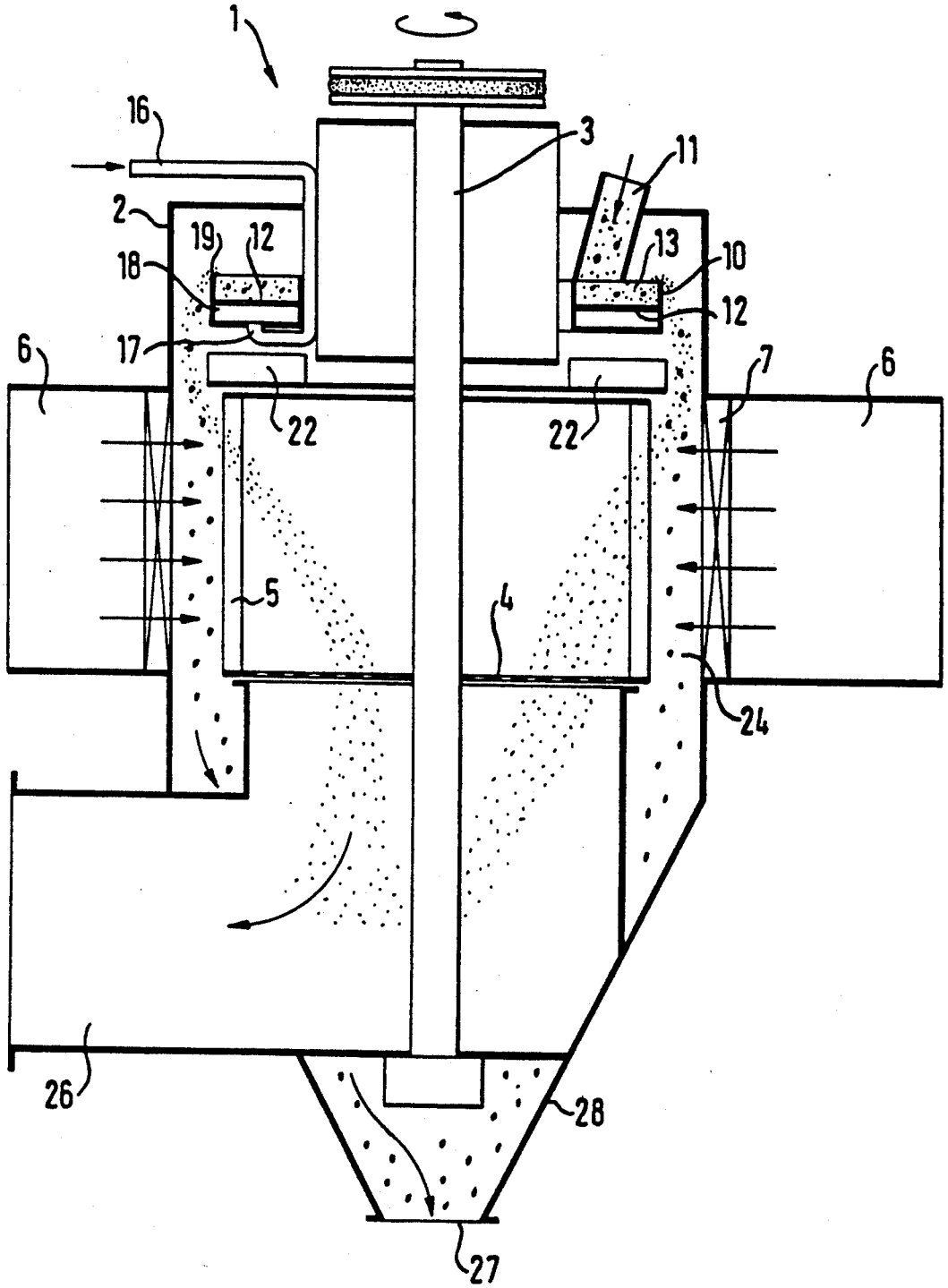
FIG. 1 A vertical section through a first embodiment of a spreading classifier.

FIG. 1 shows a vertical section through a spreading classifier 1 with a classifier basket 4 driven by means of the central shaft 3. The casing 2 of the spreading classifier 1 essentially has a circular cylindrical shape, which passes in the lower part into a hopper 28 for the coarse material outlet 27. Annular or spiral classifying air ducts 6 are portioned level with the classifier basket 4, which has radially external classifying strips 5. From the said classifying air ducts 6, the classifying air flows through a vane ring 7 substantially tangentially into the classifying chamber 24.

Above the classifier basket 4 is provided a roughly U-shaped air channel 10, which is fixed in stationary manner to the classifier casing. This upwardly open air channel 10 is provided with a horizontally positioned perforated plate 12 at roughly half the height. Below said perforated plate 12 is formed an air chamber 18, into whose bottom flows by means of a supply line 16 compressed air having a rotary, rising flow direction. The material supply 11 above the air channel 10 is inclined in the direction of the desired rotary movement of the material in the air channel.

Thus, in operation the material to be classified introduced by means of the material supply 11 is kept above the perforated plate 12 by the air blown in below it in the manner of a fluidized medium and is blown out over the radially outer edge 19 of the air channel in uniformly distributed manner in the vicinity of the classifying chamber.

Roughly rectangular accelerating blades 22 positioned on the top of the classifier basket 4 give the material dispersed by means of the air channel a further tangential acceleration, so that the material particles pass in well dispersed manner into the classifying chamber 24 in the area between the classifier strips 5 and the vane ring 7.

The fine material passing through the classifying strips 5 into the classifier basket 4 is drawn off at the bottom in the present case by means of the fine material outlet 26. There could be a further fine material discharge direction vertically upwards over the interior of the basket 4. The coarse material with the heavier particles is fed in the classifier 1, via the hopper 28 into the coarse material outlet 27.

The adjustment of the supplied compressed air by means of the supply lines 16, 17 makes it possible, independently of the rotation of the classifier basket 4, to give a movement to the infed material to be classified, which allows it to flow in the manner of a water trough, so that a well dispersed material is supplied to the classifying zone.

Figure 2:
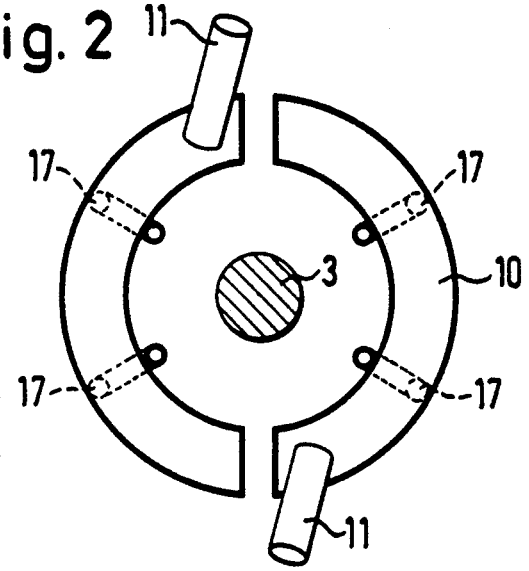
FIG. 2 A plan view of the area of an air channel of another air classifier embodiment, the air channel being pitch circular.

FIG. 2 shows in plan view an air channel 10 in a pitch circular design. The air channel 10 has two roughly semicircular channel portions which are arranged coaxially around the shaft 3 and in each case have supply lines 17 in the lower area. Moreover, for each semicircle of the air channel 10 is provided a separate material supply 11, which is positioned at the start of the flow direction of the material to be dispersed.

Figure 3:
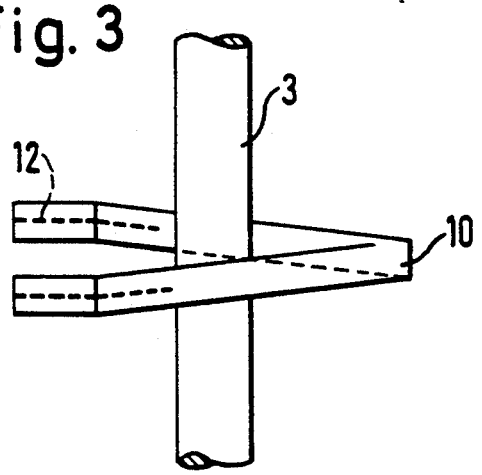
FIG. 3 A diagrammatic vertical section of another embodiment of a spreading classifier in the vicinity of the air channel, which is spiral in the axial direction of the classifier, the central shaft 3 being shown in fragmentary form.

FIG. 3 diagrammatically shows a vertical view of another embodiment of an air channel 10. In this embodiment the air channel 10 passed spirally and not horizontally in the axial direction of the central shaft 3, the start and finish of the channel 10 not overlapping in plan view.

Figure 4:
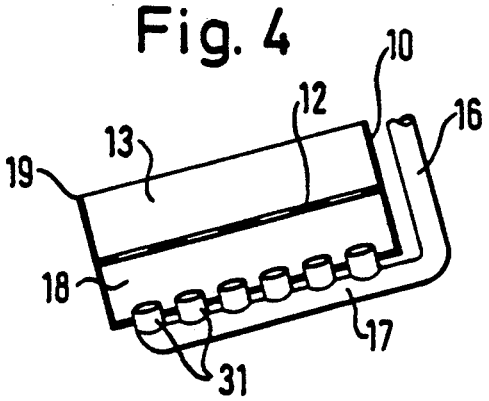
FIG. 4 A vertical section through the area of another embodiment of an air channel with an inclination thereof towards the radially outer region.

Another alternative and improvement of the air channel is shown in FIG. 4 with a diagrammatic representation of a vertical section through another air channel 10. The radially outer edge 19 of the air channel 10 is lowered with respect to the inner edge or the air channel 10 has a radially outwardly directed inclination, so that the material to be dispersed fed in above the perforated plate 12 flows radially outwards towards the edge in the free surface 13, in addition to the fluid movement in the direction of the blown-in air flow. In the embodiment according to FIG. 4 the air cushion produced in the air chamber 18 is obtained by means of a plurality, e.g. six intake nozzles 31, which are connected to an air supply line 16. These intake nozzles 31 are preferably introduced into the air chamber with an inclination relative to the underside of the air channel, so that a circumferential tangential flow is produced.

What is claimed is:

1. An apparatus for a spreading classifier with a vertical rotation axis for the dispersion of material comprising a classifying chamber, an upper material supply means for supplying material, a material feed surface means for receiving material from said supply means and being mounted substantially coaxially to the vertical rotation axis of the spreading classifier, said surface means having a marginal area via which dispersed material is supplied to the classifying chamber, and including a channel means for a gaseous fluid having a sieve-like surface, which is constructed as a material feed surface upon which the supply material is received for being moved to and over the marginal area, and gas means for fluidizing material received on the sieve-like surface and for moving same to and over the marginal area, wherein the channel means is of spiral form extending in the axial direction of the spreading classifier.

2. An apparatus according to claim 1, wherein the channel means has a bottom surface which defines with the sieve-like surface a fluid chamber.

3. An apparatus according to claim 1, wherein the channel means has an annular construction with an upper opening.

4. An apparatus according to claim 1, wherein the channel means is of partial annular form with an upper opening.

5. An apparatus according to claim 1, wherein the channel means extends horizontally.

6. An apparatus according to claim 1, wherein the channel means has a substantially U-shaped contour and the sieve-like surface is provided at about half the height of the channel means.

7. An apparatus according to claim 1, wherein the gas means is supplied with compressed air to effect a rotary inflow and rising air flow in the channel means.

8. An apparatus according to claim 7, wherein the gas means are located adjacent the bottom surface of the channel means.

9. An apparatus according to claim 7, wherein the gas means includes a plurality of inlets uniformly distributed over the circumference of the channel means.

10. An apparatus according to claim 1, wherein the marginal area of the channel means is defined by an upper, radially outer edge and both the channel means and the sieve-like surface are inclined downwardly and radially outwardly.

11. An apparatus for a spreading classifier with a vertical rotation axis for the dispersion of material comprising a classifying chamber, an upper material supply means for supplying material, a material feed surface means for receiving material from said supply means and being mounted substantially coaxial to the vertical rotation axis of the spreading classifier, said surface means having a marginal area via which dispersed material is supplied to the classifying chamber, and including a channel means having a sieve-like surface, which is constructed as a material feed surface upon which the supply material is received for being moved to and over the marginal area, and gas means for fluidizing material received on the sieve-like surface and for moving same to and over the marginal area, wherein the channel means has a substantially U-shaped contour and the sieve-like surface is provided at about half the height of the channel means.

12. An apparatus for a spreading classifier with a vertical rotation axis for the dispersion of material comprising:

an upper material supply means for supplying material, a material feed surface means for receiving material from said supply means and being mounted substantially coaxial to the vertical rotation axis of the spreading classifier, said surface means having a marginal area via which dispersed material is supplied to the classifying chamber, and including:

a channel means for a gaseous fluid, having a bottom surface and an upper sieve-like surface which is constructed as said material feed surface, and a fluid chamber for the gaseous fluid is formed between said bottom surface and said sieve-like surface of the material feed surface, wherein the marginal area of the channel means is defined by an upper, radially outer edge and both the channel means and the sieve-like surface are inclined downwardly and radially outwardly.

13. An apparatus according to claim 12, wherein the channel means has an annular construction with an upper opening.

14. An apparatus according to claim 12, wherein the channel means is of partial circular form with an upper opening.

15. An apparatus according to claim 12, wherein the channel means extends horizontally.

16. An apparatus according to claim 12, wherein the gas means is supplied with compressed air to effect a rotary inflow and rising air flow in the channel means.

17. An apparatus according to claim 16, wherein the gas means are located adjacent the bottom surface of the channel means.

18. An apparatus according to claim 16, wherein the gas means includes a plurality of inlets uniformly distributed over the circumference of the channel means.

19. An apparatus for a spreading classifier with a vertical rotation axis for the dispersion of material comprising a classifying chamber, an upper material supply means for supplying material, a material feed surface means for receiving material from said supply means and being mounted substantially coaxial to the vertical rotation axis of the spreading classifier, said surface means having a marginal area via which dispersed material is supplied to the classifying chamber, and including a channel means having a sieve-like surface, which is constructed as a material feed surface upon which the supply material is received for being moved to and over the marginal area, and gas means for fluidizing material received on the sieve-like surface and for moving same to and over the marginal area, wherein the channel means is positioned above the classifying chamber and rotary accelerating blades are mounted therebetween.

* * * * *